United States Patent [19]

Pallanch

[11] Patent Number: 4,554,799

[45] Date of Patent: Nov. 26, 1985

[54] MULTI-STAGE GAS COMPRESSOR SYSTEM AND DESUPERHEATER MEANS THEREFOR

[75] Inventor: Francis T. Pallanch, Minneapolis, Minn.

[73] Assignee: Vilter Manufacturing Corporation, Milwaukee, Wis.

[21] Appl. No.: 665,565

[22] Filed: Oct. 29, 1984

[51] Int. Cl.[4] ..... F25B 1/10

[52] U.S. Cl. ..... 62/509; 62/510; 417/243

[58] Field of Search ..... 62/175, 509, 510; 417/243

[56] References Cited

U.S. PATENT DOCUMENTS

| | | | |
|---|---|---|---|
| 2,024,323 | 12/1935 | Wyld | 62/510 |
| 2,453,095 | 11/1948 | McGrath | 62/510 X |
| 2,587,485 | 2/1952 | Kline | 62/510 X |
| 4,105,372 | 8/1978 | Mishina et al. | 417/243 |

*Primary Examiner*—William E. Tapolcai

*Attorney, Agent, or Firm*—James E. Nilles; Thomas F. Kirby

[57] ABSTRACT

A refrigeration system comprises an evaporator which feeds uncompressed vapor to a first (low) stage compressor, a second (high) stage compressor which receives low compression vapor from the first stage and feeds high compression vapor to a condenser, and a receiver which receives liquid from the condenser and ultimately feeds it to the evaporator. Desuperheater apparatus, comprising a pressure vessel (subcooler) and a heat exchanger, is provided to remove excess heat (superheat) from the compressed vapor fed by the first stage to the second stage to thereby improve thermal efficiency of the system and to reduce the mass of refrigerant to be handled by the second stage thereby enabling use of a smaller, more economical second stage compressor. The pressure vessel contains a bath of liquid which is supplied from the receiver and then fed to the evaporator. Compressed vapor from the first stage is forced through and cooled by the liquid bath in the pressure vessel and is then fed to the second stage, along with vapor which evaporates from the liquid bath. The heat exchanger has one side through which compressed vapor from the first stage passes (and is cooled) on its way to the pressure vessel. The heat exchanger has another side through which an over-supply of liquid is pumped (or gravity fed) from the receiver and then returned to the receiver as a liquid/vapor mixture.

10 Claims, 4 Drawing Figures h AND H VALUES FROM BUREAU OF STANDARDS
No. 142 TABLES OF THERMODYNAMICS PROPERTIES OF AMMONIA
h = BTU PER LB. - LIQUID
H = BTU PER LB. - VAPOR

MULTI-STAGE GAS COMPRESSOR SYSTEM AND DESUPERHEATER MEANS THEREFOR

BACKGROUND OF THE INVENTION

1. Field of Use

This invention relates generally to multi-stage gas compressor systems such as are used in refrigeration systems or the like and, in particular, to desuperheater means for such compressor systems.

2. Description of the Prior Art

A typical compression type refrigeration system generally comprises a evaporator, a motor-driven compressor and a condenser. A refrigerant, such as Freon or the like, which is under low pressure is evaporated in the evaporator which, for example, takes the form of a coiled pipe in a cooling or freezing compartment. This evaporation lowers the temperature in the compartment. The compressor draws away the vapor from the evaporator, compresses it, and passes it to the condenser where it parts with its heat. As a result of the combination of increased pressure and loss of heat, the refrigerant condenses from the gaseous to the liquid phrase. Finally, the liquid refrigerant is expanded to a lower pressure and is returned to the evaporator, whereupon the foregoing cycle is repeated as necessary.

In some large commercial type refrigeration systems, the pressure spread between the gaseous and liquid phase of the refrigerant is so great that a single stage compressor cannot compress the gas to the liquid phase. Therefore, it is necessary to employ a multi-stage compressor system which embodies two or more compressors connected in series with one-another or a multi-stage compressor in which two or more stages in a common housing are connected in series with each other.

In such a multi-stage compressor system, conditions arise which necessitate provisions of some means to desuperheat the partially compressed discharge gas from the first compressor or first compressor stage (both hereinafter sometimes referred to as the "first stage") before it is fed to the second compressor or second compressor stage (both hereinafter sometimes referred to as the "second stage").

First, the second stage is subject to overheating if the hot first stage discharge gas is introduced directly into the second stage suction.

Second, the second stage compressor efficiency is increased if the suction is cooled, even though the second stage mass flow is greater due to the evaporated liquid refrigerant that provided the cooling. At the lower temperature, the suction gas has a lower specific volume. Although the net efficiency effect of desuperheating the first stage discharge is positive by comparison to no desuperheating, the second stage compressor is still required to handle the additional mass flow required for desuperheating.

Prior art desuperheater means for multi-stage compressor systems sometimes provide for desuperheating the discharge gas of the first stage by means of a pressure vessel wherein the first stage discharge is forced through a bath of liquid refrigerant at an intermediate temperature. The heat removed by this process is not transferred to the second stage compressor. More specifically, the first stage discharge goes to the pressure vessel (desuperheater/subcooler). The discharge is directed downward below the level of liquid refrigerant maintained in the vessel. The hot discharge gas bubbling through the relatively cold saturated liquid is desuperheated. The heat given up by the discharge gas is absorbed by the liquid refrigerant and vaporizes a portion of the liquid. The desuperheater discharge gas, along with the gas created from the liquid by desuperheating is directed to the second stage. The second-stage must handle the entire flow. The aforementioned desuperheating means results in an overall increase in system thermal efficiency. As already mentioned, desuperheating is necessary. However, it does put additional load on the second stage compressor. U.S. Pat. No. 2,024,323 issued Dec. 17, 1935 to Wyld and U.S. Pat. No. 3,964,891 issued June 22, 1976 to Krieger illustrate prior art multi-stage compressor systems and cooling means therefor.

SUMMARY OF THE PRESENT INVENTION

In accordance with the present invention, there is provided improved desuperheater means or apparatus for use in a multi-stage gas compressor system such as is employed in a refrigeration system or the like.

The refrigeration system comprises an evaporator which feeds uncompressed vapor to a first (low) stage compressor, a second (high) stage compressor which receives compressed vapor from the first stage and feeds highly compressed vapor to a condenser, and a receiver which receives liquid from the condenser and ultimately feeds it to the evaporator.

The desuperheater means or apparatus, comprises a pressure vessel (subcooler) and a heat exchanger, and operates to remove excess heat (superheat) from the compressed vapor fed by the first stage to the second stage to thereby improve thermal efficiency of the refrigeration system and compressor system and to reduce the mass of refrigerant to be handled by the second stage, thereby enabling use of a smaller, more economical second stage compressor. The pressure vessel contains a bath of liquid which is supplied from the receiver and then fed to the evaporator. Compressed vapor from the first stage is forced through and cooled by the liquid bath in the pressure vessel and is then fed to the second stage. The heat exchanger has one side through which compressed vapor from the first stage passes (and is cooled) on its way to the pressure vessel. The heat exchanger has another side through which an over-supply of liquid is pumped (or gravity fed) from the receiver and then returned to the receiver as a liquid/vapor mixture.

The desuperheater means or apparatus in accordance with the invention improves thermal efficiency, as explained above, and lessens the otherwise higher mass flow which would be required to be handled by the second stage, thereby removing an additional load from the second stage and, instead, transfers the load to the condenser. This results in an energy saving since, as calculations show, there is a reduction on the order of 12% in flow requirements for the second stage compressor. By diverting the load to the condenser, one is actually not adding any load to the condenser, since the mass flow in the system remains the same.

The addition of a desuperheater heat exchanger enables removal of some of the superheat using second stage liquid and rejecting the heat in the condenser rather than first going through mechanical compression in the second stage compressor. Liquid is supplied to the desuperheater heat exchanger either by gravity head or by a mechanical pump. In fact, the heat exchanger is actually overfed with liquid to insure good heat transfer and the liquid/gas mixture is returned to the receiver. The mixture of gas and liquid are basically separated in the liquid receiver with the gas going up through the adequately sized equalizer pipe to the condenser inlet to be recondensed. Calculations show that typically a 12% saving in second stage horsepower and an overall efficiency improvement on the order of 12% can be achieved.

Other objects and advantages of the invention will hereinafter appear.

IN THE DRAWINGS

DESCRIPTION OF THE PREFERRED EMBODIMENTS

Figure 1:
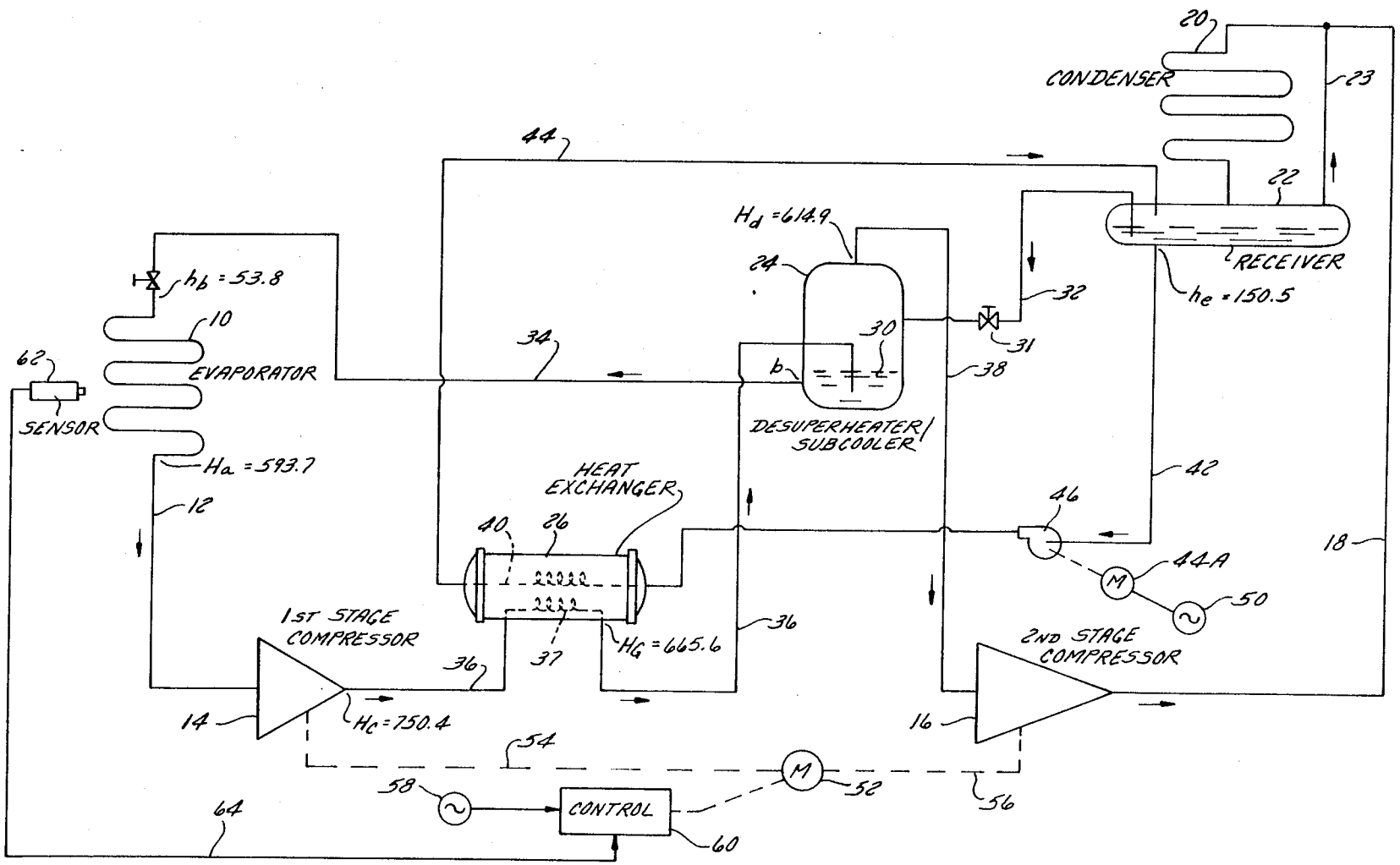
FIG. 1 is a schematic diagram of a first embodiment of a refrigeration system employing a two-stage compressor system and desuperheater means in accordance with the invention.

Referring to FIG. 1, there is shown an embodiment of a refrigeration system which employs a multi-stage compressor system and desuperheater means or apparatus therefor in accordance with the present invention.

Figure 2:
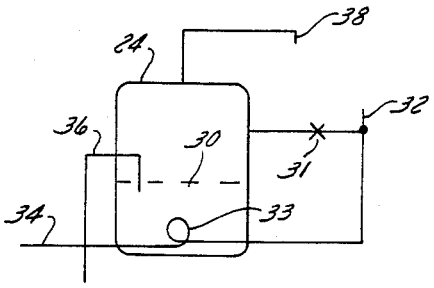
FIG. 2 is a schematic diagram of a modified form of desuperheater/subcooler usable in place of that shown in FIG. 1.
Figure 3:
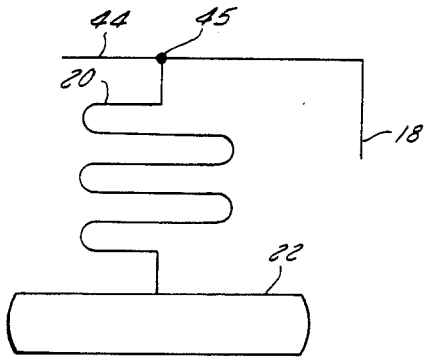
FIG. 3 is a schematic diagram of a modified form of connection for the condenser and receiver shown in FIG. 1.

The refrigeration system generally comprises a evaporator 10 which feeds uncompressed vapor through a pipe line 12 to a first (low) stage compressor 14, a second (high) stage compressor 16 which receives compressed vapor from the first stage compressor 14 and feeds high pressure compressed vapor through a pipe line 18 to a condenser 20 wherein it liquifies, and a receiver 22 which receives liquid from the condenser 20 and ultimately feeds it to the evaporator 10 wherein the liquid evaporates. Desuperheater apparatus, comprising a pressure vessel or subcooler 24 and a heat exchanger 26, is provided to remove excess heat (superheat) from the compressed vapor fed by the first stage compressor 14 to the second stage compressor 16, to thereby improve thermal efficiency of the refrigeration system and the compressor sytem and to reduce the mass of refrigerant to be handled by the second stage compressor 16, thereby enabling use of a smaller, more economical second stage compressor 16. The pressure vessel 24 contains a bath of liquid 30 which is supplied from the receiver 22 through a pipe line 32, which contains an expansion valve 31, and then fed to the evaporator 10 through a pipe line 34. FIG. 2 shows an alternative arrangement wherein a portion of the liquid in line 32 is diverted through coiled tube 33 located in the bath 30 in pressure vessel 24 and from thence directly to pipe line 34 which is no longer connected to the bath of liquid 30. The arrangement in FIG. 2 enables more positive feed of high pressure liquid to evaporator 10 than the arrangement in FIG. 1 and this is advantageous in some systems. Compressed vapor from the first stage compressor 14 travels through a pipe line 36 and is forced through and cooled by the liquid bath 30 in the pressure vessel 24 and is then fed through a pipe line 38 to the second stage compressor 16, along with vapor generated by bath 30 as it is heated. The heat exchanger 26 has one side formed by a coiled portion 37 of pipeline 36 through which compressesd vapor from the first stage compressor 14 passes (and is cooled) on its way to the pressure vessel 24. The heat exchanger 26 has another side formed by a coil 40 through which an over-supply of liquid is fed from a pipe line 42 connected to the receiver 24 and then returned through a pipe line 44 to the receiver 22 as a liquid/vapor mixture. FIG. 3 shows an alternative arrangement wherein return pipe line 44 is connected at a point 45 to line 18 ahead of receiver 22 and wherein a pipe line 23, shown in FIG. 1 between receiver 22 and the inlet to condenser 20, may be omitted. Normally, the line 23 shown in FIG. 1 needs to be of relatively large diameter and the arrangement of FIG. 3 eliminates the need for line 23. The pipe line 42 contains a pump 46 which is operated by a motor 44A which is energized from an electric power source 50. If preferred, pump 46 may be omitted and liquid supplied by gravity feed from receiver 22, provided the latter is located above heat exchanger 26.

The compressors 14 and 16 may, for example, take the form of two separate machines driven by a common electric motor 52 through suitable drive systems shown schematically at 54 and 56 or could take the form of a single machine having two separate compressor stages housed therewithin. Motor 52 is energizable from an electric power source 58 through a motor controller 60 which is responsive, for example, to a system condition such as temperature or pressure sensed by a sensing device 62 (such as a thermostat or pressure switch) which is connected to motor controller 60 by electrical conductors 64.

The system shown in FIG. 1 operates as follows. The low compression vapor from the first stage 14 flows through line 36 to the vessel 24 and is discharged into the liquid 30 in vessel 24. The hot low compression vapor bubbles up through the relatively cold saturated liquid 30 and is desuperheated. The heat given up by the low compression vapor is absorbed by the liquid 30 and vaporizes a portion of the liquid 30. The desuperheated discharge gas, along with the gas created from the liquid 30, is directed through line 38 to the second stage 16. However, the low compression vapor from first stage 14 was previously cooled in heat exchanger 26 before reaching the vessel 24. As the low pressure vapor passes through the coil portion 37 of the heat exchanger 26, it adds heat to the liquid received through line 42 from the receiver causing a mixture of liquid and vapor to return through line 44 to the receiver 22. Any vapor in receiver 22 is able to pass through the pipe line 23 from the receiver 22 to the input end of the condenser 20, as FIG. 1 shows.

Figure 4:
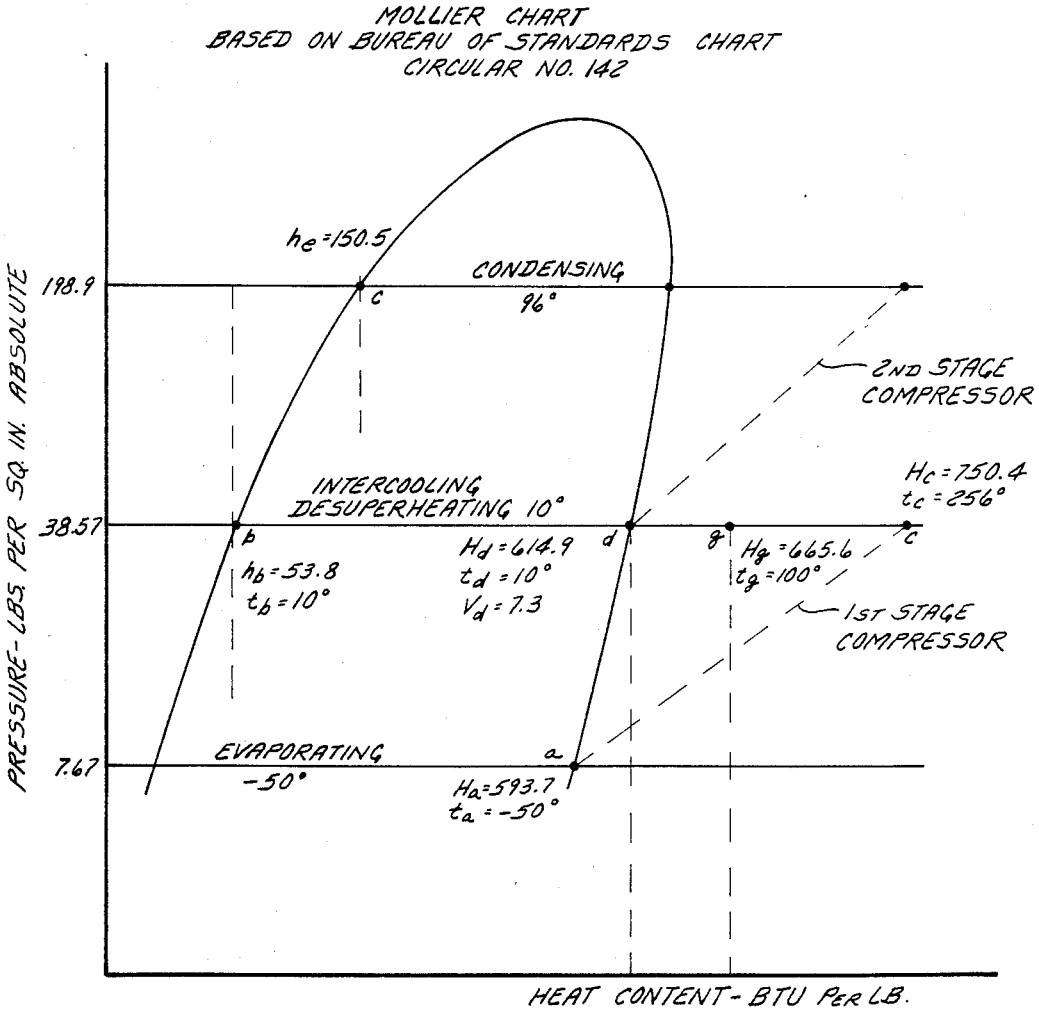
FIG. 4 is a Mollier Chart exemplifying the principle involved in applicant's invention and employing a typical set of system conditions.

The several components 10, 14, 16, 20, 22, 24 (except for the specific connections shown in FIGS. 1 and 2) and 26 are known types of conventional apparatus. In an embodiment in which the first stage compressor 14 took the form of a Model VRS-1700 compressor manufactured and sold by Vilter Manufacturing Corporation, 2217 South First Street, Milwaukee, Wis. 53207, the assignee of the present application, the follow assumptions and calculations were made which showed that a 12% reduction in mass flow and a 12% saving in horsepower would accrue to the second stage compressor 16 if the latter also took the form of a Model VRS-1700 machine, thereby enabling use of a machine smaller and less expensive than the VRS-1700. Typical system conditions such as pressure and temperature at various points in one type of system using ammonia during operation may, for example, be as follows and as shown in the Mollier Chart shown in FIG. 4 and at points in FIG. 1.

Example—Two-stage compression system

Refrigerant ammonia R 717
Evaporating Pressure 7.67 PSIA
Evaporating Temperature—50° F.
Intermediate Pressure 38.51 PSIA
Intermediate Intercooling Temperature 10° F.
Condensing Pressure 198.9 PSIA
Condensing Temperature 96° F. (1st stage)
Manufacturer's booster compressor rating at the given conditions 122 tons and 167 BH
Heat exchanger sized to cool
1st stage compressor discharge
Vapor to 100° at intermediate pressure
Reference for thermodynamic properties of Ammonia Bureau of Standards Circular No. 142
Nomenclature
Enthalpy—Heat content
BTU—British Thermal Unit
lb—Pound
Min—minute
PSIA—Pounds per square inch absolute
h—Enthalpy of liquid BTU per lb
Subletter indicates point on Mollier chart
H—Enthalpy of vapor BTU per lb
Subletter indicates point on Mollier chart
20F.—degree Fahrenheit
Hp—Horse Power 1. 1st stage refrigerant flow rate (122 tons) (200 BTU per min)=24,400 BTU per min. Enthalpy added (BTU per lb) in evaporator Ha-hb=593.7−53.8=539.9 BTU per lb $$\text{Flow rate} = \frac{24{,}000}{539.9} = 45.2 \text{ lb per min}$$

2. Enthalpy added per lb in 1st stage compressor converting 167 HP to BTU per min=167×42.42=7084 BTU per min Enthalpy added by 1st stage compressor =

$$\frac{7084}{45.2} = 156.7 \text{ BTU per lb}$$

3. 1st stage compressor discharge vapor Enthalpy Hc-Ha+(Enthalpy added by compressor) =593.7+156.7=750.4 BTU per lb 4. Enghalpy of 1st stage compressor discharge vapor reduced in heat exchanger
   Enthalpy of 1st stage compressor discharge vapor entering heat
   Exchanger Hc=750.4 BTU per lb
   Enthalpy of 1st stage compressor discharge vapor leaving heat
   Exchanger at the given condition 38.51 PSIA and 100° F.
   From thermo dynamic table
   Hg=665.6 BTU per lb
   Enthalpy change in heat exchanger
   Hc-Hg=750.4−665.6=84.8 BTU per lb 5. 2nd stage compressor load per lb of regrigerant circulated through 1st stage part of the system without heat exchanger
   Hc-hb=750.4−53.8=696.6 BTU per lb
   2nd stage compressor load per lb of refrigerant circulated through 1st stage part of the system with heat exchanger
   Hg-hb=665.6−53.8=611.8 BTU per lb 6. Savings in 2nd stage load $$\frac{(Hc - Hg)}{(Hc - hb)} \times 100 =$$

$$\frac{(750.4 - 665.6)}{(750.4 - 53.9)} 100 =$$

$$\frac{84.8}{696.6} \times 100 = 12\%$$

Since the 2nd stage HP varies directly with the load there is a 12% saving in 2nd stage compressor BH.

I claim:

1. In combination:

a multi-stage compressor system wherein a first compressor stage supplies low compression vapor to a second compressor stage which supplies high compression vapor to a condenser wherein the high compression vapor condenses as a liquid;

and desuperheat means for removing heat from said low compression vapor prior to passage of said low compression vapor to said second compressor stage to thereby improve the thermal efficiency of said system and to reduce the mass of vapor to be handled by said second compressor stage and comprising:

heat exchanger means for transferring heat from said low compression vapor to said liquid;

and a vessel containing a body of said liquid through which said low compression vapor is bubbled to transfer additional heat to said liquid.

2. In combination:

a multi-stage compressor system wherein a first compressor stage supplies low compression vapor to a second compressor stage which supplies high compression vapor to a condenser wherein the high compression vapor condenses as a liquid;

and desuperheater means for removing heat from said low compression vapor prior to passage of said low compression vapor to said second compression stage and comprising:

heat exchanger means through which said low compression vapor passes for transferring heat from said low compression vapor to liquid from said condenser;

and a pressure vessel containing a body of liquid from said condenser through which said low compression vapor is passed after passing through said heat exchanger for transferring additional heat from said low compression vapor.

3. A combination according to claim 2 wherein said compressor system comprises a receiver for receiving liquid from said condenser;

wherein said heat exchanger has one side for receiving liquid from said receiver and for returning a mixture of vapor and liquid to said receiver;

wherein said heat exchanger has another side for passage of said low compression vapor therethrough;

and wherein said pressure vessel receives liquid from said receiver and supplies low compression vapor to said second compressor stage.

4. A combination according to claim 3 wherein said desuperheater means comprises a pump for supplying liquid from said receiver to said one side of said heat exchanger.

5. A combination according to claim 3 wherein said receiver is located above said heat exchanger and liquid is gravity-fed from the former to the latter.

6. A combination according to claim 3 or 4 or 5 wherein said compressor system comprises an evaporator for receiving liquid from said pressure vessel and for supplying vapor to said first compressor stage.

7. A refrigeration system comprising:

a first compressor stage;

an evaporator which feeds uncompressed vapor to said first compressor stage;

a condenser;

a second compressor stage which receives compressed vapor from said first stage and feeds liquid to said condenser;

a receiver which receives liquid from said condenser and ultimately feeds it to said evaporator;

and desuperheater apparatus comprising a pressure vessel and a heat exchanger to remove heat from said compressed vapor fed by said first stage to said second stage to thereby improve thermal efficiency of said system and to reduce the mass of refrigerant to be handled by said second stage;

said pressure vessel containing a bath of liquid which is supplied from said receiver and then fed to said evaporator and through which compressed vapor from said first stage is forced and cooled before being fed to said second stage along with vapor from said bath of liquid;

said heat exchanger having one side through which said compressed vapor from said first stage passes and is cooled on its way to said pressure vessel;

said heat exchanger having another side through which liquid is fed from said receiver and then returned to said receiver as a liquid/vapor mixture.

8. A system according to claim 7 wherein said desuperheater apparatus comprises means for positively feeding liquid from said receiver to said heat exchanger.

9. A system according to claim 8 wherein said means is a pump.

10. A system according to claim 8 wherein said means is a gravity feed system wherein said receiver is above said heat exchanger.

* * * * *